US009993691B2

(12) United States Patent
Watanabe et al.

(10) Patent No.: US 9,993,691 B2
(45) **Date of Patent: *Jun. 12, 2018**

(54) MULTI-PIECE SOLID GOLF BALL

(71) Applicant: Bridgestone Sports Co., Ltd., Minato-ku, Tokyo (JP)

(72) Inventors: Hideo Watanabe, Chichibushi (JP); Akira Kimura, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/460,732

(22) Filed: Mar. 16, 2017

(65) Prior Publication Data

US 2017/0182372 A1 Jun. 29, 2017

Related U.S. Application Data

(63) Continuation-in-part of application No. 14/859,802, filed on Sep. 21, 2015, now Pat. No. 9,636,548.

(30) Foreign Application Priority Data

Nov. 27, 2014 (JP) ..... 2014-240420

(51) Int. Cl.
*A63B 37/06* (2006.01)
*A63B 37/00* (2006.01)

(52) U.S. Cl.
CPC ..... *A63B 37/0076* (2013.01); *A63B 37/004* (2013.01); *A63B 37/0063* (2013.01);
(Continued)

(58) Field of Classification Search
CPC ..... A63B 37/0084; A63B 37/0076
(Continued)

(56) References Cited

U.S. PATENT DOCUMENTS 6,913,547 B2 7/2005 Cavallaro et al.
7,335,115 B1 2/2008 Watanabe et al.
(Continued)

FOREIGN PATENT DOCUMENTS

JP 2006-230661 A 9/2006
JP 2007-319660 A 12/2007
(Continued)

OTHER PUBLICATIONS

Communication dated Jan. 30, 2018 from the Japanese Patent Office in counterpart Application No. 2014-240420.

*Primary Examiner* — Raeann Gorden
(74) *Attorney, Agent, or Firm* — Sughrue Mion, PLLC

(57) ABSTRACT

In a multi-piece solid golf ball having a core, an envelope layer, an intermediate layer, and a cover with a plurality of dimples thereon, the core is a two-layer core consisting of an inner core layer and an outer core layer each formed primarily of a base rubber, the envelope layer, the intermediate layer and the cover layer are each composed of at least one layer and formed primarily of a synthetic resin material, and the initial velocities and surface hardnesses of the core, the envelope layer-encased sphere and the intermediate layer-encased sphere are designed within specific ranges. This golf ball satisfies at a very high level the flight and control performances expected for use by professional golfers and skilled amateurs, has the ability to move forward on a straight path particularly on full shots, and also has an excellent scuff resistance.

9 Claims, 1 Drawing Sheet

(52) U.S. Cl.
CPC ..... *A63B 37/0081* (2013.01); *A63B 37/0084* (2013.01); *A63B 37/0092* (2013.01)

(58) Field of Classification Search
USPC ..... 473/376
See application file for complete search history.

(56) References Cited

U.S. PATENT DOCUMENTS

| | | | | |
|---|---|---|---|---|
| 7,625,302 | B2 | 12/2009 | Watanabe et al. | |
| 7,918,749 | B2 | 4/2011 | Watanabe et al. | |
| 8,523,707 | B2 | 9/2013 | Watanabe et al. | |
| 8,764,584 | B2 | 7/2014 | Watanabe et al. | |
| 8,771,103 | B2 | 7/2014 | Watanabe et al. | |
| 9,433,832 | B2 | 9/2016 | Watanabe | |
| 9,636,548 | B2 * | 5/2017 | Watanabe ..... | A63B 37/0076 |
| 2007/0281801 | A1 | 12/2007 | Watanabe et al. | |
| 2008/0305890 | A1 * | 12/2008 | Watanabe ..... | A63B 37/0063 473/373 |
| 2013/0296076 | A1 | 11/2013 | Kimura et al. | |
| 2014/0194221 | A1 | 7/2014 | Watanabe | |

FOREIGN PATENT DOCUMENTS

| | | | |
|---|---|---|---|
| JP | 4017228 | B2 | 12/2007 |
| JP | 2009-95358 | A | 5/2009 |
| JP | 2013-230363 | A | 11/2013 |

* cited by examiner

MULTI-PIECE SOLID GOLF BALL

CROSS-REFERENCE TO RELATED APPLICATION

This application is a continuation-in-part of copending application Ser. No. 14/859,802 filed on Sep. 21, 2015, the entire contents of which are hereby incorporated by reference.

BACKGROUND OF THE INVENTION

Field of the Invention

The present invention relates to a multi-piece solid golf ball having at least a five-layer construction that includes a two-layer core, an envelope layer, an intermediate layer and a cover layer. The invention relates in particular to a multi-piece solid golf ball capable of delivering overall a ball performance which is fully acceptable to professional golfers and skilled amateur golfers.

Prior Art

Various golf balls have hitherto been developed for professional golfers and skilled amateurs. Of these, from the standpoint of achieving both a superior distance performance in the high head-speed range and good controllability on shots with an iron and on approach shots, multi-piece solid golf balls having an optimized hardness relationship among the layers encasing the core, such as the intermediate layer and the cover layer, are in widespread use. Moreover, because not only the flight performance, but also the feel of the ball at impact and the spin rate of the ball after being struck by a club have a large influence on control of the ball, one important topic in golf ball development is optimizing the thicknesses and hardnesses of the golf ball layers in order to achieve the best possible feel and spin rate. Furthermore, there exists a desire for the ball to have durability to repeated impact and for scuffing observed on the ball surface when a golf ball is repeatedly hit with different clubs to be suppressed (increased scuff resistance), maximal protection of the ball from external factors also being an important topic in golf ball development.

Such golf balls that have appeared in the art include the golf ball having a three-layer cover and a two-layer core described in U.S. Pat. No. 7,625,302. In addition, golf balls having a three-layer cover and a one-layer core are described in U.S. Pat. Nos. 8,523,707, 8,771,103, 7,335,115, 7,918,749 and 8,764,584.

Also, U.S. Pat. No. 6,913,547 discloses a golf ball having a two-layer cover and a two-layer core, and JP No. 4017228 describes a golf ball having a two-layer core and a one-layer cover.

However, these prior-art golf balls, in spite of possessing multilayer structures of the sort described above, have not yet achieved an adequately reduced spin rate on shots with a driver. Hence, there exists a desire for the development of a golf ball which can provide the further increase in distance expected by professionals and skilled amateurs. Moreover, in terms of golf ball performance, there is also a desire for the ball to have a good controllability on approach shots, to have the ability to move forward on a straight path particularly on full shots, to have a good scuff resistance, and to be fully acceptable to professional golfers and skilled amateurs.

It is therefore an object of the invention to provide a multi-layer solid golf ball which, along with satisfying at a very high level the flight and control performances expected for use by professional golfers and skilled amateurs, has the ability to move forward on a straight path, particularly on full shots, and also has an excellent scuff resistance.

SUMMARY OF THE INVENTION

As a result of extensive investigations, we have discovered that, in the constitute pieces (also referred to here as "layers") of a golf ball, i.e., the core, the envelope layer, the intermediate layer and the cover layer, by forming the core as a two-layer structure consisting of an inner core layer formed primarily of a base rubber and an outer core layer formed primarily of the same or a different base rubber, by focusing on the initial velocities of the respective layer-encased spheres and specifying the relationships among these initial velocities, and by designing the ball in such a way that the surface hardness of the intermediate layer-encased sphere is higher than the surface hardness of the envelope layer-encased sphere and the surface hardness of the ball, there can be obtained a golf ball which is able to satisfy the flight and controllability performances at a very high level, has the ability to move forward on a straight path particularly on full shots, and also has an excellent scuff resistance. Among conventional golf balls, three-piece golf balls having a urethane cover are widely used as golf balls endowed with both the controllability and excellent flight performance desired by professional golfers and skilled amateurs. Compared with such conventional golf balls, the golf ball of this invention enhances the reduction in spin rate on full shots with a driver (W#1) and is able to further extend the distance traveled by the ball, not only on full shots with a driver, but also on full shots with an iron. Moreover, the golf ball of this invention, in addition to being endowed with the above ball performance, also possesses an excellent scuff resistance, and thus is fully capable of enduring even harsh service conditions.

Accordingly, the invention provides a multi-piece solid golf ball which has a core, an envelope layer that encases the core, an intermediate layer that encases the envelope layer, and a cover layer that encases the intermediate layer and has formed on an outer surface thereof a plurality of dimples. The core is a two-layer core consisting of an inner core layer formed primarily of a base rubber and an outer core layer formed primarily of the same or a different base rubber. The diameter of the overall core is from 35.3 to 39 mm and the initial velocity of the ball is not less than 77.2 m/s. The envelope layer, the intermediate layer and the cover layer are each composed of at least one layer, and formed primarily of a synthetic resin material. Moreover, the golf ball satisfies conditions (1) to (3) below:

(initial velocity of envelope layer-encased sphere−initial velocity of core)>−0.4 m/s; (1)

(initial velocity of intermediate layer-encased sphere−initial velocity of envelope layer-encased sphere)>0.4 m/s; and (2)

surface hardness (Shore D) of envelope layer-encased sphere<surface hardness (Shore D) of intermediate layer-encased sphere>surface hardness (Shore D) of ball. (3)

In a preferred embodiment, the initial velocity of intermediate layer-encased sphere in the multi-piece solid golf ball of the invention is not less than 78.3 m/s and the initial velocity of envelop layer-encased sphere is not less than 77.6 m/s.

In further preferred embodiment, the multi-piece solid golf ball of the invention further satisfies conditions (4) and (5) below:

initial velocity of ball<initial velocity of intermediate layer-encased sphere>initial velocity of envelope layer-encased sphere; and (4)

cover thickness<intermediate layer thickness<envelope layer thickness<core diameter. (5)

In another preferred embodiment, the two-layer core in the multi-piece solid golf ball of the invention satisfies conditions (6) and (7) below:

[surface hardness (JIS-C) of core−center hardness (JIS-C) of core]≥25; and (6)

[surface hardness (JIS-C) of core−hardness (JIS-C) at position 10 mm from core center]>[hardness (JIS-C) at position 10 mm from core center−center hardness (JIS-C) of core]. (7)

In yet another preferred embodiment, the two-layer core in the multi-piece solid golf ball of the invention satisfies condition (7') below:

[surface hardness (JIS-C) of core−hardness (JIS-C) at position 10 mm from core center]>[hardness (JIS-C) at position 10 mm from core center−center hardness (JIS-C) of core]×2. (7')

In a still further preferred embodiment, the two-layer core in the multi-piece solid golf ball of the invention satisfies condition (7") below:

[surface hardness (JIS-C) of core−hardness (JIS-C) at position 10 mm from core center]>[hardness (JIS-C) at position 10 mm from core center−center hardness (JIS-C) of core]×3. (7")

In another preferred embodiment, the multi-piece solid golf ball of the invention further satisfies conditions (8) and (9) below:

−10<[surface hardness (Shore D) of envelope layer-encased sphere−surface hardness (Shore D) of core]<7; and (8)

$0.75 \leq E/C \leq 0.90$, where $C$ (mm) and $E$ (mm) are the deflections of, respectively, the core and the envelope layer-encased sphere when compressed under a final load of 1,275 N (130 kgf) from an initial load of 98 N (10 kgf). (9)

In yet another preferred embodiment, the multi-piece solid golf ball of the invention further satisfies conditions (10) and (11) below:

10<[surface hardness (Shore D) of intermediate layer-encased sphere−surface hardness (Shore D) of envelope layer-encased sphere]<25; and (10)

$0.75 \leq M/E \leq 0.85$, where $E$ (mm) and $M$ (mm) are the deflections of, respectively, the envelope layer-encased sphere and the intermediate layer-encased sphere when compressed under a final load of 1,275 N (130 kgf) from an initial load of 98 N (10 kgf). (11)

In still another preferred embodiment, the multi-piece solid golf ball of the invention further satisfies conditions (12) to (14) below:

−3≤[surface hardness (Shore D) of ball−surface hardness (Shore D) of intermediate layer-encased sphere]<−20; (12)

−2.0 m/s (initial velocity of ball−initial velocity of intermediate layer-encased sphere)<0 m/s; and (13)

$0.85 \leq B/M \leq 0.95$, where $M$ (mm) and $B$ (mm) are the deflections of, respectively, the intermediate layer-encased sphere and the ball when compressed under a final load of 1,275 N (130 kgf) from an initial load of 98 N (10 kgf). (14)

The golf ball of this invention satisfies at a very high level the flight and control performances expected for use by professional golfers and skilled amateurs, has the ability to move forward on a straight path particularly on full shots, and also has an excellent scuff resistance.

DESCRIPTION OF THE DIAGRAMS

DETAILED DESCRIPTION OF THE INVENTION

The objects, features and advantages of the invention will become more apparent from the following detailed description, taken in conjunction with the foregoing diagrams.

Figure 1:
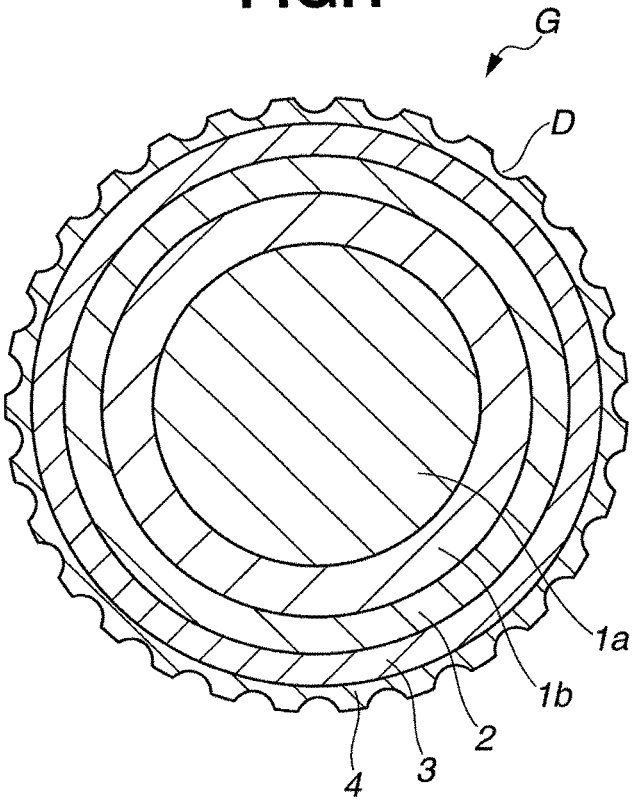
FIG. 1 is a schematic cross-sectional diagram of a multi-piece solid golf ball according to the invention.

The multi-piece solid golf ball of the invention has, arranged in order from the inside of the golf ball, a core, an envelope layer, an intermediate layer and a cover layer. In addition, the core has a two-layer construction consisting of an inner core layer and an outer core layer. For example, referring to FIG. 1, a golf ball G has a plurality of five or more layers, including an inner core layer 1*a* and an outer core layer 1*b*, an envelope layer 2 encasing the core, an intermediate layer 3 encasing the envelope layer 2, and a cover layer 4 encasing the intermediate layer 3. Numerous dimples are formed on the outer surface of the cover layer 4. The pieces of the golf ball other than the core, i.e., the envelope layer, the intermediate layer and the cover layer, each have at least one layer, but are not limited to a single layer and may be formed of a plurality of two or more layers.

As noted above, the core is formed in two layers: an inner core layer and an outer core layer. The diameter of the core (the overall core consisting of the inner core layer and the outer core layer is referred to below simply as the "core"), although not particularly limited, is preferably at least 35.3 mm, more preferably at least 35.6 mm, and even more preferably at least 36 mm, with the upper limit being preferably not more than 39 mm, more preferably not more than 38 mm, and even more preferably not more than 37 mm. When the core diameter falls outside of this range, the ball initial velocity may decrease or the spin rate-lowering effect on full shots may be inadequate, as a result of which a good distance may not be obtained.

The deflection of the core when compressed under a final load of 1,275 N (130 kgf) from an initial load of 98 N (10 kgf), although not particularly limited, is preferably at least 3.0 mm, more preferably at least 3.3 mm, and even more preferably at least 3.5 mm, with the upper limit being preferably not more than 7.0 mm, more preferably not more than 6.0 mm, and even more preferably not more than 4.5 mm. When this value is too small, meaning that the core is too hard, the spin rate may rise excessively, possibly resulting in a poor distance, or the feel at impact may be too hard. On the other hand, when this value is too large, meaning that the core is too soft, the rebound of the ball may be too low, resulting in a poor distance, or the feel at impact may be too soft and the durability to cracking on repeated impact may worsen.

The core has a surface hardness expressed in terms of JIS-C hardness which, although not particularly limited, is preferably at least 70, more preferably at least 75, and even more preferably at least 80, with the upper limit being preferably not more than 100, more preferably not more than 95, and even more preferably not more than 90. The core surface hardness expressed in terms of Shore D hardness is preferably at least 45, more preferably lat least 49, and even more preferably at least 53, with the upper limit being preferably not more than 68, more preferably not more than 64, and even more preferably not more than 60. When the surface hardness is too small, the rebound may be too low, resulting in a poor distance, or the feel at impact may be too soft and the durability to cracking on repeated impact may worsen. On the other hand, when the surface hardness is too large, the spin rate may rise excessively, resulting in a poor distance or the feel at impact may be too hard.

The (surface hardness of core–center hardness of core) value, expressed in terms of JIS-C hardness, is preferably at least 25, more preferably at least 30, and even more preferably at least 37, with the upper limit being preferably not more than 55, and more preferably not more than 47. This hardness difference, expressed in terms of Shore D hardness, is preferably at least 19, more preferably at least 23, and even more preferably at least 28, with the upper limit being preferably not more than 42, and more preferably not more than 36. When this hardness difference value is too small, the spin rate may be too high, resulting in a poor distance. On the other hand, when this value is too large, the durability to repeated impact may worsen, or the rebound may become low, resulting in a poor distance.

The inner core layer has a diameter of preferably at least 15 mm, more preferably at least 17 mm, and even more preferably at least 20 mm, with the upper limit being preferably not more than 30 mm, more preferably not more than 28 mm, and even more preferably not more than 25 mm. When the inner core layer diameter falls outside of this range, the initial velocity of the ball may decrease and the spin rate-lowering effect may be inadequate, as a result of which a good distance may not be obtained, or the durability to cracking under repeated impact may worsen.

The inner core layer has a center hardness expressed in terms of JIS-C hardness which is preferably at least 33, more preferably at least 38, and even more preferably at least 43, with the upper limit being preferably not more than 63, more preferably not more than 58, and even more preferably not more than 53. The center hardness, expressed in terms of Shore D hardness, is preferably at least 17, more preferably at least 21, and even more preferably at least 25, with the upper limit being preferably not more than 40, more preferably not more than 36, and even more preferably not more than 32. When the core center is too hard, the spin rate may rise excessively resulting in a poor distance, or the feel at impact may be too hard. On the other hand, when the core center is too soft, the rebound may be too low, resulting in a poor distance, or the feel at impact may be soft and the durability to cracking on repeated impact may worsen.

The hardness at a position 5 mm from the core center, expressed in terms of JIS-C hardness, is preferably at least 36, more preferably at least 41, and even more preferably at least 46, with the upper limit being preferably not more than 66, more preferably not more than 61, and even more preferably not more than 56. Outside this range, the spin rate-lowering effect on full shots may be inadequate and the rebound may be low, as a result of which a good distance may not be obtained.

The hardness at a position 10 mm from the core center, expressed in terms of JIS-C hardness, is preferably at least 41, more preferably at least 46, and even more preferably at least 51, with the upper limit being preferably not more than 71, more preferably not more than 66, and even more preferably not more than 61. Outside this range, the spin rate-lowering effect on full shots may be inadequate and the rebound may be low, as a result of which a good distance may not be obtained.

The (hardness at a position 10 mm from core center–center hardness of core) value, expressed in terms of JIS-C hardness, is preferably at least 0, more preferably at least 3, and even more preferably at least 5, with the upper limit being preferably not more than 15, and more preferably not more than 10. Outside this range, the spin rate-lowering effect on full shots may be inadequate and the rebound may be lower, as a result of which a good distance may not be obtained.

The (surface hardness of core–hardness at a position 10 mm from core center) value, expressed in terms of JIS-C hardness, is preferably at least 17, more preferably at least 22, and even more preferably at least 29, with the upper limit being preferably not more than 55, more preferably not more than 47, and even more preferably not more than 39. Outside this range, the spin rate-lowering effect on full shots may be inadequate and the rebound may be lower, as a result of which a good distance may not be obtained.

Letting A be the (surface hardness of core–hardness at a position 10 mm from core center) value and B be the (hardness at a position 10 mm from core center–center hardness of core) value, it is preferable for $A>B$, more preferable for $A>2\times B$, and even more preferable for $A>3\times B$. Outside this range, the spin rate-lowering effect on full shots may be inadequate and the rebound may be low, as a result of which a good distance may not be obtained. Also, a good feel at impact may not be obtained.

The materials making up the inner and outer core layers having the above surface hardnesses and deflections are each composed primarily of rubber materials. The rubber material used in the outer core layer which envelopes the inner core layer may be the same as or different from the material used in the inner core layer. Specifically, a rubber composition can be prepared using a base rubber as the primary component and blending with this other ingredients such as co-crosslinking agents, organic peroxides, inert fillers and organosulfur compounds. It is preferable to use polybutadiene as the base rubber.

The polybutadiene serving as this rubber component may be one having a cis-1,4 bond content on the polymer chain of at least 60%, preferably at least 80 wt %, more preferably at least 90 wt %, and most preferably at least 95 wt %. If the content of cis-1,4 bonds among the bonds on the molecule is too low, the resilience may decrease.

In addition to the above polybutadiene, the base rubber may include also other rubber ingredients, insofar as doing so does not detract from the advantageous effects of the invention. Rubber ingredients other than the above polybutadiene include polybutadienes other than the above polybutadiene, and other diene rubbers, such as styrene-butadiene rubber, natural rubber, isoprene rubber and ethylene-propylene-diene rubber.

Examples of suitable co-crosslinking agents include unsaturated carboxylic acids and the metal salts of unsaturated carboxylic acids.

Specific examples of unsaturated carboxylic acids include acrylic acid, methacrylic acid, maleic acid, and fumaric acid. Acrylic acid and methacrylic acid are especially preferred.

Metal salts of unsaturated carboxylic acids are exemplified by, without particular limitation, the above unsaturated carboxylic acids that have been neutralized with desired metal ions. Illustrative examples include the zinc and magnesium salts of methacrylic acid and acrylic acid. The use of zinc acrylate is especially preferred.

The unsaturated carboxylic acids and/or metal salts thereof are included in an amount, per 100 parts by weight of the base rubber, of generally at least 10 parts by weight, preferably at least 15 parts by weight, and more preferably at least 20 parts by weight, with the upper limit being generally not more than 60 parts by weight, preferably not more than 50 parts by weight, more preferably not more than 45 parts by weight, and most preferably not more than 40 parts by weight. Too much may make the core too hard, giving the ball an unpleasant feel at impact, whereas too little may lower the rebound.

A commercially available product may be used as the organic peroxide. Specific examples include those available under the trade names Percumyl D, Perhexa C-40 and Perhexa 3M, (all from NOF Corporation), and Luperco 231XL (from Atochem Co.). These may be used singly, or two or more may be used in combination.

The organic peroxide is included in an amount, per 100 parts by weight of the base rubber, of preferably at least 0.1 part by weight, more preferably at least 0.3 part by weight, even more preferably at least 0.5 part by weight, and most preferably at least 0.7 part by weight, with the upper limit being preferably not more than 5 parts by weight, more preferably not more than 4 parts by weight, even more preferably not more than 3 parts by weight, and most preferably not more than 2 parts by weight. If the amount included is too high or too low, it may not be possible to obtain a suitable feel, durability and rebound.

Examples of preferred inert fillers include zinc oxide, barium sulfate and calcium carbonate. These may be used singly, or two or more may be used in combination.

The amount of inert filler included per 100 parts by weight of the base rubber is preferably at least 1 part by weight, more preferably at least 2 parts by weight, and even more preferably at least 4 parts by weight, with the upper limit being preferably not more than 50 parts by weight, more preferably not more than 40 parts by weight, and even more preferably not more than 35 parts by weight. Too much or too little inert filler may make it impossible to achieve a proper weight and a suitable rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). These may be used singly, or two or more may be used in combination.

The amount of antioxidant included per 100 parts by weight of the base rubber is set to preferably at least 0 part by weight, more preferably at least 0.05 part by weight, and even more preferably at least 0.1 part by weight, with the upper limit being preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable rebound and durability.

In order to confer a good rebound, it is preferable for an organosulfur compound to be included in either or both the inner core layer and the outer core layer.

The organosulfur compound is not subject to any particular limitation, provided it is capable of enhancing the golf ball rebound. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and diphenylpolysulfides, dibenzylpolysulfides, dibenzoylpolysulfides, dibenzothiazoylpolysulfides and dithiobenzoylpolysulfides having 2 to 4 sulfurs. The use of the zinc salt of pentachlorothiophenol is especially preferred.

It is recommended that the amount of the organosulfur compound included per 100 parts by weight of the base rubber be set to preferably at least 0.05 part by weight, more preferably at least 0.1 part by weight, and even more preferably at least 0.2 part by weight, with the upper limit being preferably not more than 5 parts by weight, more preferably not more than 3 parts by weight, and even more preferably not more than 2.5 parts by weight. When too much is included, a further rebound-enhancing effect (particularly on shots with a W#1) cannot be expected, the core may become too soft and the feel at impact may worsen. On the other hand, when too little is included, a rebound-enhancing effect is unlikely.

The production of such a core composed of two layers may entail molding an inner core layer by, for example, the customary method of forming a sphere under heating and compression at a temperature of at least 140° C. but not more than 180° C. for a period of at least 10 minutes but not more than 60 minutes. The method employed to form the outer core layer on the surface of the inner core layer may involve forming a pair of half-cups from unvulcanized rubber sheet, placing and enclosing the inner core layer within the pair of half-cups, then molding under heat and pressure. For example, advantageous use may be made of a process in which initial vulcanization (semi-vulcanization) is carried out to produce a pair of hemispherical cups, following which a prefabricated inner core layer is placed in one of the hemispherical cups and covered by the other hemispherical cup, and secondary vulcanization (complete vulcanization) is subsequently carried out. Another preferred production process involves forming the rubber composition while in an unvulcanized state into sheets so as to make a pair of outer core layer sheets, and shaping the sheets with a die having a hemispherical protrusion so as to produce unvulcanized hemispherical cups. The pair of hemispherical cups is then placed over a prefabricated inner core layer and formed into a spherical shape under heating and compression at a temperature of 140 to 180° C. for a period of 10 to 60 minutes, thereby dividing the vulcanization step into two stages.

Next, the envelope layer is described.

The envelope layer has a material hardness expressed in terms of Shore D hardness which, although not particularly limited, is preferably at least 40, more preferably at least 45, and even more preferably at least 47, with the upper limit being preferably not more than 63, more preferably not more than 60, and even more preferably not more than 58. In terms of JIS-C hardness, the material hardness of the envelope layer is preferably at least 63, more preferably at least 70, and even more preferably at least 72, with the upper limit being preferably not more than 93, more preferably not more than 89, and even more preferably not more than 87. When the envelope layer is softer than the above range, the ball may be too receptive to spin on full shots, possibly resulting in a poor distance. On the other hand, when the envelope layer is harder than the above range, the durability to cracking on repeated impact may worsen and the feel at impact may become too hard. The envelope layer material is preferably selected from among materials which are softer than the intermediate layer material.

The envelope layer has a thickness which, although not particularly limited, is preferably at least 0.7 mm, more preferably at least 1.0 mm, and even more preferably at least 1.2 mm, with the upper limit being preferably not more than 2.2 mm, more preferably not more than 1.7 mm, and even more preferably not more than 1.5 mm. Outside this range, the spin rate-lowering effect on shots with a driver (W#1) may be inadequate, as a result of which a good distance may not be obtained.

The sphere obtained by encasing the core in the envelope layer (referred to below as the "envelope layer-encased sphere") has a surface hardness expressed in terms of Shore D hardness which, although not particularly limited, is preferably at least 46, more preferably at least 51, and even more preferably at least 54, with the upper limit being preferably not more than 69, more preferably not more than 66, and even more preferably not more than 64. When softer than the above range, the ball may be too receptive to spin on full shots, as a result of which a good distance may not be obtained. When harder than this range, the durability to cracking on repeated impact may worsen and the feel at impact may become too hard.

The initial velocity of the envelope layer-encased sphere is preferably not less than 77.6 m/s, more preferably not less than 77.7 m/s, and even more preferably not less than 77.8 m/s. When the initial speed of the initial velocity of the envelope layer-encased sphere is lower than the above range, the ball initial velocity may decrease or the spin rate on full shots may rise, as a result of which a good distance may not be obtained.

The envelope layer in this invention is made primarily of a resin material. The resin material in the envelope layer, although not particularly limited, is preferably a material containing as the essential component a base resin of, mixed in specific amounts: (a) an olefin-unsaturated carboxylic acid random copolymer and/or a metal ion neutralization product of an olefin-unsaturated carboxylic acid random copolymer, and (b) an olefin-unsaturated carboxylic acid-unsaturated carboxylic acid ester random copolymer and/or a metal ion neutralization product of an olefin-unsaturated carboxylic acid-unsaturated carboxylic acid ester random copolymer. That is, in this invention, by using as materials suitable for the envelope layer the materials described below, the spin rate of the ball on shots with a W#1 can be lowered, enabling a long distance to be obtained.

Commercially available products may be used as components (a) and (b). Illustrative examples of the random copolymer in component (a) include Nucrel N1560, Nucrel N1214 and Nucrel N1035 (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311, Nucrel AN4318 and Nucrel AN4319 (all products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the random copolymer include Himilan 1605, Himilan 1601 and Himilan 1555.

When preparing the base resin, the weight ratio in which component (a) and component (b) are mixed is set to generally between 100:0 and 0:100, preferably between 100:0 and 25:75, more preferably between 100:0 and 50:50, even more preferably between 100:0 and 75:25, and most preferably to 100:0. When the amount of component (a) included is too small, the resilience of moldings of the material decreases.

In the preparation of this base resin, by additionally adjusting the compounding ratio of the random copolymer and the metal ion neutralization product of the random copolymer, the moldability can be made even better. It is recommended that the (random copolymer):(metal ion neutralization product of the random copolymer) ratio be generally between 0:100 and 60:40, preferably between 0:100 and 40:60, more preferably between 0:100 and 20:80, and even more preferably 0:100. When the random copolymer content is too high, the moldability during mixing may decrease.

The component (e) described below may be added to the base resin. Component (e) is a non-ionomeric thermoplastic elastomer. The purpose of this ingredient is to enhance even further the feel of the ball at impact and the ball rebound. Examples of component (e) include olefin elastomers, styrene elastomers, polyester elastomers, urethane elastomers and polyamide elastomers. From the standpoint of further increasing the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

It is recommended that the content of component (e) per 100 parts by weight of the base resin of the invention be preferably at least 0 part by weight, more preferably at least 5 parts by weight, even more preferably at least 10 parts by weight, and most preferably at least 20 parts by weight, with the upper limit being preferably not more than 100 parts by weight, more preferably not more than 60 parts by weight, even more preferably not more than 50 parts by weight, and most preferably not more than 40 parts by weight. When the content is too high, there is a possibility of the compatibility of the mixture decreasing and of the durability of the golf ball markedly decreasing.

Next, the component (c) described below may be added to the base resin. Component (c) is a fatty acid or fatty acid derivative having a molecular weight of at least 228 but not more than 1500. Compared with the base resin, component (c) has a very low molecular weight and, by suitably adjusting the melt viscosity of the mixture, helps in particular to improve the flow properties. Component (c) includes a relatively high content of acid groups (or derivatives thereof), and is capable of suppressing an excessive loss of resilience.

A basic inorganic metal compound capable of neutralizing acid groups in the base resin and component (c) may be added as component (d). By including component (d) as an essential ingredient in the material, not only are the acid groups present on the base resin and component (c) neutralized, owing to synergistic effects from the optimization of these components, the thermal stability of the mixture increases, enabling a good moldability to be imparted and an enhanced rebound to be achieved.

Here, it is recommended that the basic inorganic metal compound serving as component (d) be one which, because it has a high reactivity with the base resin and an organic acid is not present within the reaction by-products, is able to increase the degree of neutralization of the mixture without a loss of thermal stability.

Examples of the metal ions in the basic inorganic metal compound serving as component (d) include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. A known basic inorganic filler containing these metal ions may be used as the basic inorganic metal compound. Illustrative examples include magnesium oxide, magnesium hydroxide, magnesium carbonate, zinc oxide, sodium hydroxide, sodium carbonate, calcium oxide, calcium hydroxide, lithium hydroxide and lithium carbonate. Hydroxides and monoxides are especially recommended, with calcium hydroxide and magnesium oxide, both of which have a high reactivity with the base resin, being more preferred, and calcium hydroxide being even more preferred.

As mentioned above, by including specific amounts of components (c) and (d) with respect to the resin component composed of a base resin of specific amounts of components (a) and (b) in admixture with optional component (e), the resin material has an excellent thermal stability, flowability and moldability, and can confer the resulting molded product with a dramatically improved resilience.

The amounts of components (c) and (d) included per 100 parts by weight of the resin component suitably composed of components (a), (b) and (e) are as follows. The amount of component (c) is at least 5 parts by weight, preferably at least 10 parts by weight, more preferably at least 15 parts by weight, and even more preferably at least 18 parts by weight, with the upper limit being not more than 80 parts by weight, preferably not more than 40 parts by weight, even more preferably not more than 25 parts by weight, and still more preferably not more than 22 parts by weight. The amount of component (d) is at least 0.1 part by weight, preferably at least 0.5 part by weight, more preferably at least 1 part by weight, and even more preferably at least 2 parts by weight, with the upper limit being not more than 17 parts by weight, preferably not more than 15 parts by weight, more preferably not more than 13 parts by weight, and even more preferably not more than 10 parts by weight. When the amount of component (c) included is too small, the melt viscosity decreases, lowering the processability; when the amount included is too large, the durability decreases. Too little component (d) fails to improve thermal stability and resilience, whereas to much instead lowers the heat resistance of the golf ball material owing to the presence of excess basic inorganic metal compound.

It is recommended that at least 50 mol %, preferably at least 60 mol %, more preferably at least 70 mol %, and even more preferably at least 80 mol %, of the acid groups within the resin material formulated from specific amounts of the resin component and components (c) and (d) be neutralized. Such high neutralization makes it possible to more reliably suppress the exchange reactions that cause trouble when only a base resin and a fatty acid (or fatty acid derivative) are used as in the above-cited prior art, thus preventing the generation of fatty acid. As a result, the thermal stability is substantially improved and the moldability is good, enabling molded products of much better resilience than prior-art ionomer resins to be obtained.

Here, "degree of neutralization" refers to the degree of neutralization of acid groups present within the mixture of the base resin and the fatty acid (or fatty acid derivative) serving as component (c), and differs from the degree of neutralization of the ionomer resin itself when an ionomer resin is used as the metal ion neutralization product of a random copolymer in the base resin. On comparing such a mixture having a certain degree of neutralization with an ionomer resin alone having the same degree of neutralization, the mixture contains a very large number of metal ions and thus has a higher density of ionic crosslinks which contribute to improved resilience, making it possible to confer the molded product with an excellent resilience.

Commercially available products may be used as the envelope layer material. Specific examples include those having the trade names HPF 1000, HPF 2000 and HPF AD1027, as well as the experimental material HPF SEP1264-3 (all from E.I. DuPont de Nemours & Co.).

Next, the intermediate layer is described.

The intermediate layer has a material hardness expressed in terms of Shore D hardness which, although not particularly limited, is preferably at least 50, more preferably at least 55, and even more preferably at least 60, with the upper limit being preferably not more than 70, more preferably not more than 68, and even more preferably not more than 65. In terms of JIS-C hardness, the material hardness of the intermediate layer is preferably at least 76, more preferably at least 83, and even more preferably at least 89, with the upper limit being preferably not more than 100, and more preferably not more than 96. When the intermediate layer is softer than the above range, the ball may be too receptive to spin on full shots, as a result of which a good distance may not be obtained. On the other hand, when the intermediate layer is harder than the above range, the durability to cracking under repeated impact may worsen and the feel at impact on actual shots with a putter or on short approaches may be too hard. The intermediate layer material is preferably selected from among materials which are harder than the material used to form the cover layer (outermost layer).

The intermediate layer has a thickness which, although not particularly limited, is preferably at least 0.5, more preferably at least 0.8 mm, and even more preferably at least 1.0 mm, with the upper limit being preferably not more than 2.0 mm, more preferably not more than 1.5 mm, and even more preferably not more than 1.3 mm. Also, it is preferable to form the intermediate layer to a thickness which is greater than that of the cover layer (outermost layer). At an intermediate layer thickness which is outside of the above range or smaller than the cover layer thickness, the spin rate-lowering effect on shots with a driver (W#1) may be inadequate, as a result of which a good distance may not be obtained. Also, if the intermediate layer is too thin, the durability to cracking on repeated impact and the low-temperature durability may worsen.

The intermediate layer is formed primarily of a resin material which is the same as or different from the above-described envelope layer material. Specific examples include sodium-neutralized ionomer resins such as those available under the trade names Himilan 1605, Himilan 1601 and Surlyn 8120, and zinc-neutralized ionomer resins such as those available under the trade names Himilan 1557 and Himilan 1706. These may be used singly or two or more may be used in combination.

It is especially desirable for the intermediate layer material to be in a form that is composed primarily of, in admixture, a zinc-neutralized ionomer resin and a sodium-neutralized ionomer resin. The compounding ratio thereof, expressed as the weight ratio "zinc-neutralized ionomer resin/sodium-neutralized ionomer resin," is typically from 25/75 to 75/25, preferably from 35/65 to 65/35, and more preferably from 45/55 to 55/45.

Outside of this range in the compounding ratio, the rebound of the ball may be too low, as a result of which the intended distance may not be obtained, in addition to which the durability to cracking on repeated impact at normal temperatures may worsen and the durability to cracking at low (subzero) temperatures may also worsen.

The sphere obtained by encasing the core in the envelope layer and the intermediate layer (referred to below as the "intermediate layer-encased sphere") has a surface hardness expressed in terms of Shore D hardness which, although not particularly limited, is preferably at least 55, more preferably at least 60, and even more preferably at least 63, with the upper limit being preferably not more than 80, more preferably not more than 75, and even more preferably not more than 72. When softer than the above range, the ball may be too receptive to spin on full shots, as a result of which a good distance may not be obtained. When harder than this range, the durability to cracking on repeated impact may worsen and the feel at impact on actual shots with a putter or on short approaches may be too hard.

The initial velocity of the intermediate layer-encased sphere is preferably not less than 78.3 m/s, more preferably not less than 78.4 m/s, and even more preferably not less than 78.5 m/s. When the initial speed of the initial velocity of the intermediate layer-encased sphere is lower than the above range, the ball initial velocity may decrease or the spin rate on full shots may rise, as a result of which a good distance may not be obtained.

With regard to the intermediate layer material, it is advantageous to abrade the surface of the intermediate layer in order to increase adhesion with the polyurethane that is preferably used in the subsequently described cover layer. In addition, it is desirable to apply a primer (adhesive) to the surface of the intermediate layer following such abrasion treatment or to add an adhesion reinforcing agent to the intermediate layer material.

Next, the cover layer is described.

The cover layer has a material hardness expressed in terms of Shore D hardness which, although not particularly limited, is preferably at least 35, more preferably at least 40, and even more preferably at least 44, with the upper limit being preferably not more than 60, more preferably not more than 57, and even more preferably not more than 54. In terms of JIS-C hardness, the material hardness of the cover layer is preferably at least 57, more preferably at least 63, and even more preferably at least 68, with the upper limit being preferably not more than 89, more preferably not more than 86, and even more preferably not more than 82. When the cover layer is softer than the above range, the ball may be too receptive to spin on full shots, as a result of which a good distance may not be obtained. On the other hand, when the cover layer is harder than the above range, the ball may not be receptive to spin on approach shots, as a result of which the controllability even by professional golfers and skilled amateurs may be inadequate, and the scuff resistance may worsen.

The cover layer has a thickness which, although not particularly limited, is preferably at least 0.3, more preferably at least 0.5 mm, and even more preferably at least 0.7 mm, with the upper limit being preferably not more than 1.5 mm, more preferably not more than 1.2 mm, and even more preferably not more than 1.0 mm. At a cover layer thicker than the above range, the rebound of the ball on shots with a driver (W#1) may be inadequate and the spin rate may rise, as a result of which a good distance may not be obtained. On the other hand, if the cover layer is thinner than the above range, the scuff resistance may worsen and the controllability even by professional golfers and skilled amateurs may be inadequate.

The cover layer material is formed primarily of a known synthetic resin, such as a thermoplastic resin or a thermoplastic elastomer. It is especially preferable for the cover layer material to be formed primarily of a polyurethane. By doing so, it is possible to achieve the desired effects of the invention; that is, to provide a golf ball which is satisfactory both in terms of controllability and scuff resistance.

The polyurethane used in the cover material is not particularly limited, although the use of a thermoplastic polyurethane is especially preferred from the standpoint of mass productivity.

Specifically, it is preferable to use a specific thermoplastic polyurethane composition made up primarily of (A) a thermoplastic polyurethane and (B) a polyisocyanate compound. This resin blend is described below.

The thermoplastic polyurethane (A) has a structure which includes soft segments composed of a polymeric polyol (polymeric polyol) that is a long-chain polyol, and hard segments composed of a chain extender and a polyisocyanate compound. Here, the long-chain polymer serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less that have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, an aliphatic diol having 2 to 12 carbons is preferred, and 1,4-butylene glycol is more preferred, as the chain extender.

Any polyisocyanate compound hitherto employed in the art relating to thermoplastic polyurethanes may be advantageously used without particular limitation as the polyisocyanate compound serving as component (B). For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the cross-linking reaction during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (A). Illustrative examples include Pandex T-8295, T-8290, T-8260 and T-8283 (all from DIC Bayer Polymer, Ltd.).

Although not an essential ingredient, a thermoplastic elastomer other than the above thermoplastic polyurethane may be included as component (C) together with the above components (A) and (B). By including this component (C) in the above resin blend, a further improvement in the flowability of the resin blend can be achieved and the properties required of golf ball cover materials, such as resilience and scuff resistance, can be increased.

In addition to the above resins, various additives may be optionally included in the above-described resin materials for the envelope layer, the intermediate layer and the cover layer. Examples of such additives include pigments, dispersants, antioxidants, ultraviolet absorbers, light stabilizers, internal mold lubricants, plasticizers and inert fillers (e.g., zinc oxide, barium sulfate, titanium dioxide).

The manufacture of multi-piece solid golf balls in which the above-described core, envelope layer, intermediate layer and cover layer are formed as successive layers may be carried out in the usual manner such as by a known injection-molding process. For example, a multi-piece golf ball may be obtained by placing, as the core, a molded and vulcanized product composed primarily of a rubber material in a given injection mold, injecting an envelope layer material and an intermediate layer material in turn over the core to give an intermediate sphere, and then placing the resulting sphere in another injection mold and injection-molding a cover material over the sphere. Alternatively, the cover may be formed by encasing the intermediate sphere with a cover layer using a method in which, for example, the intermediate sphere is enclosed within two half-cups that have been pre-molded into hemispherical shapes, then molding is carried out under applied heat and pressure.

The surface hardness of the golf ball (also referred to here as the surface hardness of the cover layer) is determined by the hardnesses of the materials used in the respective layers and the substrate hardness. In terms of Shore D hardness, this is preferably at least 45, more preferably at least 50, and even more preferably at least 53, with the upper limit being preferably not more than 70, more preferably not more than 65, and even more preferably not more than 62. At a surface hardness lower than this range, the ball may have too much spin receptivity on full shots, as a result of which a good distance may not be obtained. On the other hand, at a surface hardness higher than this range, the ball may not be receptive to spin on approach shots and may thus lack sufficient controllability even for professional golfers and skilled amateurs. Moreover, the scuff resistance may be excessively poor.

The deflection of the golf ball when subjected to a specific load, i.e., the deflection (mm) of the ball when compressed under a final load of 1,275 N (130 kgf) from an initial load of 98 N (10 kgf), although not particularly limited, is preferably at least 1.5 mm, more preferably at least 1.8 mm, and even more preferably at least 2.0 mm, with the upper limit being preferably not more than 4.0 mm, more preferably not more than 3.5 mm, and even more preferably not more than 3.0 mm. When this value is too low, the feel at impact may be too hard or the spin rate on full shots may rise excessively, which may cause the ball to travel on a steep trajectory and fail to achieve a good distance. On the other hand, when this value is too high, the feel at impact may become too soft or the initial velocity on actual shots with a driver (W#1) may be low, as a result of which a good distance may not be obtained.

The initial velocity of the ball, in order to conform to the R&A Rules of Golf, is preferably not more than 77.724 m/s, with the lower limit being preferably not less than 77.2 m/s, more preferably not less than 77.3 m/s, and even more preferably not less than 77.4 m/s. When the initial speed of the ball is too low, it may not be possible to obtain the intended distance on full shots. Measurement of the ball initial velocity is carried out with the measurement apparatus and under the measurement conditions described below in the Examples section.

By satisfying the conditions described below, the desired effects of the invention can be fully obtained, these being to endow the inventive golf ball with the ability to satisfy to a very high level the flight performance and controllability expected for use by professional golfers and skilled amateurs, the ability to move forward on a straight path particularly on full shots, and an excellent scuff resistance.

Relationship of Initial Velocities Among Various Spheres

In this invention, it is critical that the relationships among the initial velocities of the envelope layer-encased sphere, the intermediate layer-encased sphere and the ball satisfy conditions (1) and (2) below:

(initial velocity of envelope layer-encased sphere−initial velocity of core)>−0.4 m/s; and (1)

(initial velocity of intermediate layer-encased sphere−initial velocity of envelope layer-encased sphere>0.4 m/s. (2)

Measurement of the initial velocities of these spheres is carried out with the measurement apparatus and under the measurement conditions described below in the Examples section.

The (initial velocity of envelope layer-encased sphere−initial velocity of core) value is higher than −0.4 m/s, preferably at least −0.3 m/s, and more preferably at least −0.2 m/s, with the upper limit being preferably not more than 1.0 m/s, more preferably not more than 0.5 m/s, and even more preferably not more than 0.3 m/s. When this value is lower than the above range, the ball is too receptive to spin on full shots or has a low rebound, as a result of which the intended distance is not obtained. On the other hand, when this value is higher than the above range, the feel at impact may be too hard or the durability to cracking under repeated impact may worsen.

The (initial velocity of intermediate layer-encased sphere−initial velocity of envelope layer-encased sphere) value is higher than 0.4 m/s, preferably at least 0.5 m/s, and more preferably at least 0.6 m/s, with the upper limit being preferably not more than 1.5 m/s, and more preferably not more than 1.0 m/s. At a value outside this range, the ball is too receptive to spin on full shots or has a low rebound, as a result of which the intended distance is not be obtained.

The (initial velocity of ball−initial velocity of intermediate layer-encased sphere) value is preferably lower than 0 m/s, more preferably from −2.0 to −0.3 m/s, and even more preferably from −1.5 to −0.5 m/s. At a value outside this range, the ball may be too receptive to spin on full shots or may have a low rebound, as a result of which the intended distance may not be obtained.

Relationship of Surface Hardnesses Among Various Spheres

In this invention it is critical that the relationships among the surface hardnesses of the envelope layer-encased sphere, the intermediate layer-encased sphere and the ball satisfy condition (3) below:

surface hardness (Shore D) of envelope layer-encased sphere<surface hardness (Shore D) of intermediate layer-encased sphere>surface hardness (Shore D) of ball. (3)

The (surface hardness of ball−surface hardness of intermediate layer-encased sphere) value, expressed in terms of Shore D hardness, is lower than 0, preferably from −20 to −3, and more preferably from −15 to −5. Outside this range, the ball is too receptive to spin on full shots or has a low rebound, as a result of which the intended distance is not obtained.

The (surface hardness of intermediate layer-encased sphere−surface hardness of envelope layer-encased sphere) value, expressed in terms of Shore D hardness, is preferably from 3 to 25, more preferably from 7 to 19, and even more preferably from 10 to 16. Outside this range, the ball is too receptive to spin on full shots or has a low rebound, as a result of which the intended distance may not be obtained. In addition, the feel at impact may be poor.

The (surface hardness of envelope layer-encased sphere−surface hardness of core) value, expressed in terms of Shore D hardness, is preferably at least −10, more preferably from −7 to 10, and even more preferably from −5 to 5. At a value lower than this range, the ball is too receptive to spin on full shots, as a result of which a good distance may not be obtained. On the other hand, at a value higher than this range, the feel at impact may become too hard or the durability to cracking on repeated impact may worsen.

Relationship of Deflection Under Specific Loading Among Various Spheres

In this invention, although not particularly limited, it is desirable for the relationships among the deflections of the envelope layer-encased sphere, the intermediate layer-encased sphere and the ball to satisfy the following conditions.

Letting C (mm) and E (mm) represent the deflections of, respectively, the core and the envelope layer-encased sphere when compressed under a final load of 1,275 N (130 kgf) from an initial load of 98 N (10 kgf), the value E/C is preferably from 0.70 to 0.92, more preferably from 0.75 to 0.90, and even more preferably from 0.80 to 0.86. At a value outside this range, the ball is too receptive to spin on full shots and has a low rebound, as a result of which the intended distance may not be obtained. Also, the feel at impact may be hard and the controllability may be poor.

Letting E (mm) and M (mm) represent the deflections of, respectively, the envelope layer-encased sphere and the intermediate layer-encased sphere when compressed under a final load of 1,275 N (130 kgf) from an initial load of 98 N (10 kgf), the value M/E is preferably from 0.69 to 0.91, more preferably from 0.72 to 0.88, and even more preferably from 0.75 to 0.85. At a value outside this range, the ball is too receptive to spin on full shots and has a low rebound, as a result of which the intended distance may not be obtained. Also, the feel at impact may be hard and the controllability may be poor.

Letting M (mm) and B (mm) represent the deflections of, respectively, the intermediate layer-encased sphere and the ball when compressed under a final load of 1,275 N (130 kgf) from an initial load of 98 N (10 kgf), the value B/M is preferably from 0.77 to 0.99, more preferably from 0.81 to 0.97, and even more preferably from 0.85 to 0.95. At a value outside of this range, the ball is too receptive to spin on full shots and has a low rebound, as a result of which the intended distance may not be obtained. Also, the feel at impact may be hard and the controllability may be poor.

Numerous dimples may be formed on the outer surface of the cover layer. The number of dimples arranged on the outer surface of the cover layer, although not particularly limited, is preferably at least 280, more preferably at least 300, and even more preferably at least 320, with the upper limit being preferably not more than 360, more preferably not more than 350, and even more preferably not more than 340. If the number of dimples is larger than this range, the ball trajectory may become low, as a result of which the distance may decrease. On the other hand, if the number of dimples is smaller than this range, the ball trajectory may become high, as a result of which a good distance may not be achieved.

The golf ball of the invention can be made to conform to the Rules of Golf for play. Specifically, the inventive ball may be formed to a diameter such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 to 4, Comparative Examples 1 to 9

In each Example, an inner core layer and an outer core layer were fabricated by preparing rubber compositions for the inner core layer and the outer core layer according to the formulations shown in Table 1, then carrying out molding and vulcanization at 155° C. for 13 minutes in Examples 1 to 4 and Comparative Examples 1 to 6 and 9, and at 155° C. for 15 minutes in Comparative Examples 7 and 8. That is, the inner core layer and outer core layer were formed as successive layers by formulating and vulcanizing the rubber composition for the inner core layer shown in Table 1, subsequently wrapping the outer core layer composed of the material shown in Table 2 in an unvulcanized state around the periphery of the resulting inner core layer, and then molding and vulcanizing the resulting sphere.

TABLE 1

| | | Example | | | | Comparative Example | | | | | | | | |
|---|---|---|---|---|---|---|---|---|---|---|---|---|---|---|
| (parts by weight) | | 1 | 2 | 3 | 4 | 1 | 2 | 3 | 4 | 5 | 6 | 7 | 8 | 9 |
| Inner core layer formulation | Polybutadiene I | 80 | 80 | 80 | 80 | 80 | 80 | 80 | 80 | 80 | 80 | | | 80 |
| | Polybutadiene II | 20 | 20 | 20 | 20 | 20 | 20 | 20 | 20 | 20 | 20 | | | 20 |
| | Polybutadiene III | | | | | | | | | | | 100 | 100 | |
| | Zinc acrylate | 15.5 | 13.5 | 15.5 | 13.5 | 15.5 | 13.5 | 24.5 | 15.5 | 15.5 | 15.5 | 17 | 17 | 13.5 |
| | Organic peroxide | 1.2 | 1.2 | 1.2 | 1.2 | 1.2 | 1.2 | 2.5 | 1.2 | 1.2 | 1.2 | 1.2 | 1.2 | 1.2 |
| | Barium sulfate | 27.9 | 28.8 | 27.9 | 28.8 | 28.3 | 28.4 | 33.8 | 27.6 | 20.8 | 21.4 | | | 28.8 |

TABLE 1-continued

| | (parts by weight) | Example 1 | 2 | 3 | 4 | Comparative Example 1 | 2 | 3 | 4 | 5 | 6 | 7 | 8 | 9 |
|---|---|---|---|---|---|---|---|---|---|---|---|---|---|---|
| | Antioxidant | 0.1 | 0.1 | 0.1 | 0.1 | 0.1 | 0.1 | 0.1 | 0.1 | 0.1 | 0.1 | 0.1 | 0.1 | 0.1 |
| | Zinc oxide | 4 | 4 | 4 | 4 | 4 | 4 | 4 | 4 | 4 | 4 | 34.6 | 34.6 | 4 |
| | Zinc salt of pentachlorothiophenol | 0.2 | 0.2 | 0.2 | 0.2 | 0.2 | 0.2 | 0.2 | 0.2 | 0.2 | 0.2 | 2.5 | 2.5 | 0.2 |
| | Zinc stearate | | | | | | | | | | | 5 | 5 | |
| Outer core layer formulations | Polybutadiene I | 80 | 80 | 80 | 80 | 80 | 80 | — | 80 | 80 | 80 | | | 80 |
| | Polybutadiene II | 20 | 20 | 20 | 20 | 20 | 20 | — | 20 | 20 | 20 | | | 20 |
| | Polybutadiene III | | | | | | | — | | | | 100 | 100 | |
| | Zinc acrylate | 39.5 | 37 | 39.5 | 38.5 | 39.5 | 37 | — | 39.5 | 39.5 | 39.5 | 35.0 | 35.0 | 37 |
| | Organic peroxide | 1.2 | 1.2 | 1.2 | 1.2 | 1.2 | 1.2 | — | 1.2 | 1.2 | 1.2 | 1.2 | 1.2 | 1.2 |
| | Barium sulfate | 17.8 | 18.9 | 17.8 | 18.1 | 18.2 | 18.5 | — | 17.4 | 10.0 | 10.7 | | | 18.9 |
| | Antioxidant | 0.1 | 0.1 | 0.1 | 0.1 | 0.1 | 0.1 | — | 0.1 | 0.1 | 0.1 | 0.1 | 0.1 | 0.1 |
| | Zinc oxide | 4 | 4 | 4 | 4 | 4 | 4 | — | 4 | 4 | 4 | 28.3 | 28.3 | 4 |
| | Zinc salt of pentachlorothiophenol | 0.2 | 0.2 | 0.2 | 0.5 | 0.2 | 0.2 | — | 0.2 | 0.2 | 0.2 | 2 | 2 | 0.2 |
| | Zinc stearate | | | | | | | | | | | 5 | 5 | |

Trade names for the principal materials in the table are as follows. Numbers in the table indicate parts by weight.

Polybutadiene I: Available under the trade name "BR01" from JSR Corporation

Polybutadiene II: Available under the trade name "BR51" from JSR Corporation

Polybutadiene III: Available under the trade name "BR730" from JSR Corporation

Organic peroxide: A mixture of 1,1-di(t-butylperoxy)cyclohexane and silica, available under the trade name "Perhexa C-40" from NOF Corporation Barium sulfate: Available as "Precipitated Barium Sulfate #100" from Sakai Chemical Co., Ltd.

Antioxidant: 2,2'-Methylenebis(4-methyl-6-t-butylphenol), available under the trade name "Nocrac NS-6" from Ouchi Shinko Chemical Industry Co., Ltd.

Formation of Envelope Layer, Intermediate Layer and Cover Layer

Figure 2:
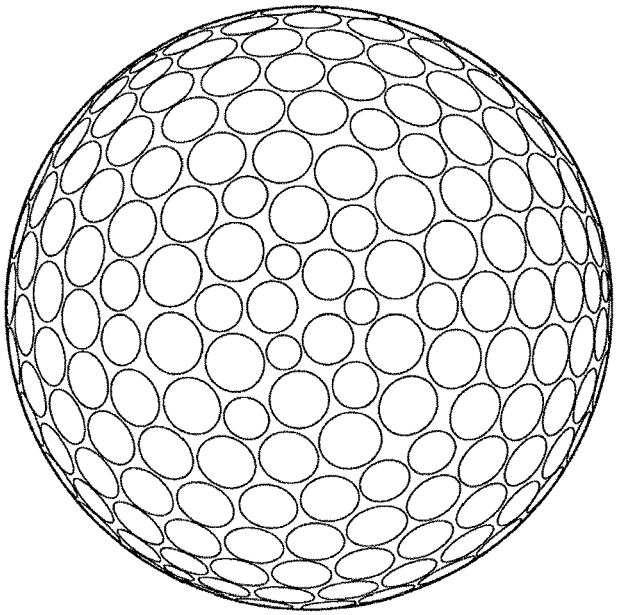
FIG. 2 is a top view of a golf ball showing the arrangement of dimples used in the examples of the invention.

Next, in each Example, an envelope layer, an intermediate layer and a cover layer formulated from the various resin components shown in Table 2 were injection-molded as successive layers over the two-layer core to form the various layer-encased spheres. Then, using the common dimple pattern shown in Table 3 and FIG. 2, multi-piece solid golf balls having these dimples formed on the outside surface of the cover layer were fabricated.

TABLE 2

| Resin material ingredients (pbw) | No. 1 | No. 2 | No. 3 | No. 4 | No. 5 | No. 6 | No. 7 | No. 8 | No. 9 |
|---|---|---|---|---|---|---|---|---|---|
| T-8290 | | | | | | 75 | | | |
| T-8283 | | | | | | 25 | | | |
| HPF 2000 | | | 100 | | | | | | |
| Himilan 1706 | | | | 50 | 100 | | 35 | 15 | |
| Himilan 1557 | | | | | | | 15 | | |
| Himilan 1605 | | | | 50 | | | 50 | | |
| Surlyn 9320 | 70 | | | | | | | | |
| Surlyn 8120 | | 75 | | | | | | | |
| Surlyn 7930 | | | | | | | | | 37 |
| Surlyn 6320 | | | | | | | | | 36 |
| AM7318 | | | | | | | | 70 | |
| AM7329 | | | | | | | | 15 | |
| Nucrel AN4221C | 30 | | | | | | | | |
| Nucrel AN4318 | | | | | | | | | 27 |
| Dynaron 6100P | | 25 | | | | | | | |
| Hytrel 4001 | | | | | | 11 | | | |
| Titanium oxide | | | | | | 3.9 | | | |
| Polyethylene wax | | | | | | 1.2 | | | |
| Isocyanate compound | | | | | | 7.5 | | | |
| Trimethylolpropane | | | 1.1 | 1.1 | 1.1 | | 1.1 | 1.1 | |
| Behenic acid | | 20 | | | | | | | |
| Calcium hydroxide | | 2.3 | | | | | | | |
| Calcium stearate | | 0.15 | | | | | | | |
| Zinc stearate | | 0.15 | | | | | | | |
| Magnesium oxide | 1.12 | | | | | | | | |
| Magnesium stearate | 60 | | | | | | | | |

Trade names for the principal materials in the table are as follows.

T-8290, T-8283: MDI-PTMG type thermoplastic polyurethanes available from DIC Bayer Polymer under the trademark Pandex.

HPF 2000: Available from E.I. DuPont de Nemours & Co. as "HPF™ 2000"

Himilan, AM7318, AM7329: Ionomers available from DuPont-Mitsui Polychemicals Co., Ltd.

Surlyn: Ionomers available from E.I. DuPont de Nemours & Co.

Nucrel: Ethylene-methacrylic acid copolymers available from DuPont-Mitsui Polychemicals Co., Ltd.

Dynaron 6100P: A hydrogenated polymer available from JSR Corporation

Hytrel 4001: A polyester elastomer available from DuPont-Toray Co., Ltd.

Polyethylene wax: Available as "Sanwax 161P" from Sanyo Chemical industries, Ltd.

Isocyanate compound: 4,4'-Diphenylmethane diisocyanate

Behenic acid: NAA222-S (beads), available from NOF Corporation

Calcium hydroxide: CLS-B, available from Shiraishi Kogyo

Magnesium oxide: Available as "Kyowamag" from Kyowa Chemical Industry Co., Ltd.

TABLE 3

| No. | Number of dimples | Diameter (mm) | Depth (mm) | $V_o$ | SR (%) | VR (%) |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of the surface area of a hypothetical sphere were the ball to have no dimples on the surface thereof.

VR: Sum of spatial volumes of individual dimples formed below flat plane circumscribed by the edge of a dimple, as a percentage of the volume of a hypothetical sphere were the ball to have no dimples on the surface thereof.

For each of the golf balls obtained in Examples 1 to 4 and in Comparative Examples 1 to 9, properties such as the surface hardnesses and initial velocities of the various layer-encased spheres and of the ball itself, and also the flight performance (on shots with a driver and shots with an iron), spin on approach shots (controllability) and scuff resistance of the ball, were measured according to the criteria shown below. The results are shown in Tables 4-I, 4-II, 5-I and 5-II. All of the measurements were carried out in a 23° C. environment.

Diameters of Core, Envelope Layer-Encased Sphere and Intermediate Layer-Encased Sphere The diameter at five random places on the surface of a single core, envelope layer-encased sphere or intermediate layer-encased sphere was measured at a temperature of 23.9±1° C., and the average of the five measurements was determined. Next, the average measured values thus obtained for five individual cores, five individual envelope layer-encased spheres and five individual intermediate layer-encased spheres were used to determine the average diameters of the core, the envelope layer-encased sphere and the intermediate layer-encased sphere.

Ball Diameter

The diameters at five random dimple-free places (lands) on the surface of a ball were measured at a temperature of 23.9±1° C. and, using the average of these measurements as the measured value for a single ball, the average diameter for five measured balls was determined.

Deflections of Core, Envelope-Encased Sphere, Intermediate Layer-Encased Sphere and Ball The core, envelope-encased sphere, intermediate layer-encased sphere or ball was placed on a hard plate, and the amount of deflection when compressed under a final load of 1,275 N (130 kgf) from an initial load of 98 N (10 kgf) was measured for each. The amount of deflection here refers to the measured value obtained after holding the test specimen isothermally at 23.9° C.

Center Hardness and Surface Hardness of Core (Shore D and JIS-C Hardnesses)

To determine the center hardness of the core, the hardness at the center of the cross-section obtained by cutting a spherical core in half through the center was measured. To determine the surface hardness of the core, measurements were taken by pressing the durometer indenter perpendicularly against the surface of the spherical core. The Shore D hardness was measured with a type D durometer in accordance with ASTM D2240-95, and the JIS-C hardness was measured with the spring-type durometer (JIS-C model) specified in JIS K 6301-1975.

Material Hardnesses (Shore D Hardnesses) of Envelope Layer, Intermediate Layer and Cover Layer The resin materials for, respectively, the envelope layer, the intermediate layer and the cover layer were formed into sheets having a thickness of 2 mm and left to stand for at least two weeks, following which the Shore D hardnesses were measured in accordance with ASTM D2240-95.

Surface Hardnesses (Shore D Hardnesses) of Envelope Layer-Encased Sphere, Intermediate Layer-Encased Sphere and Ball Measurements were taken by pressing the durometer indenter perpendicularly against the surface of the envelope-encased sphere, the intermediate layer-encased sphere or the ball (cover layer). The surface hardness of the ball (cover layer) is the measured value obtained at dimple-free places (land) on the ball surface. The Shore D hardnesses were measured with a type D durometer in accordance with ASTM D2240-95.

Initial Velocities of Core, Envelope Layer-Encased Sphere, Intermediate Layer-Encased Sphere and Ball The initial velocities were measured using an initial velocity measuring apparatus of the same type as the USGA drum rotation-type initial velocity instrument approved by the R&A. The cores, envelope layer-encased spheres, intermediate layer-encased spheres and balls (referred to below as "spherical test specimens") were held isothermally in a 23.9±1° C. environment for at least 3 hours, and then tested in a chamber at a room temperature of 23.9±2° C. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

Flight Performance on Shots with a Driver

A club (TourStage X-Drive 709 (loft angle, 9.5°); manufactured by Bridgestone Sports Co., Ltd.) was mounted on a golf swing robot, and the total distance traveled by the ball when struck at a head speed (HS) of 45 m/s was measured. The flight performance was rated according to the following criteria. In addition, the spin rate of the ball immediately after being similarly struck was measured with an apparatus for measuring the initial conditions.

Good: Total distance was 227.0 m or more

NG: Total distance was less than 227.0 m

Flight Performance on Shots with an Iron

An iron (I#6) (TourStage X-Blade 709 MC; manufactured by Bridgestone Sports Co., Ltd.) was mounted on a golf swing robot, and the total distance traveled by the ball when struck at a head speed (HS) of 45 m/s was measured. The flight performance was rated according to the following criteria. In addition, the spin rate was measured in the same way as described above.

Good: Total distance was 176.0 m or more

NG: Total distance was less than 176.0 m

Performance on Approach Shots

A sand wedge (SW) (TourStage X-Wedge, manufactured by Bridgestone Sports Co., Ltd.) was mounted on a golf swing robot, and the spin rate of the ball when hit at a head speed (HS) of 20 m/s was measured. The performance was rated according to the following criteria. The spin rate was measured by the same method as described above for flight performance measurement.

Good: Spin rate was 6,000 rpm or more

NG: Spin rate was less than 6,000 rpm

Scuff Resistance

A non-plated pitching sand wedge was set in a swing robot, and the ball was hit once at a head speed (HS) of 40 m/s, following which the surface state of the ball was visually examined and rated as follows.

Good: Can be used again

NG: Cannot be used again

TABLE 4-I

| | | | Example | | | |
|---|---|---|---|---|---|---|
| | | | 1 | 2 | 3 | 4 |
| Core | Inner core layer | Material | rubber | rubber | rubber | rubber |
| | | Diameter (mm) | 23.2 | 23.2 | 23.2 | 23.2 |
| | | Weight (g) | 7.7 | 7.7 | 7.7 | 7.7 |
| | | Center hardness (JIS-C) | 49 | 47 | 49 | 47 |
| | | Center hardness (Shore D) | 29 | 28 | 29 | 28 |
| | | Hardness 5 mm from center (JIS-C) | 52 | 50 | 52 | 50 |
| | | Hardness 10 mm from center (JIS-C) | 58 | 54 | 58 | 54 |
| | | Hardness 10 mm from center − Center hardness (JIS-C) | 9 | 7 | 9 | 7 |
| | Outer core layer | Material | rubber | rubber | rubber | rubber |
| | | Thickness (mm) | 6.6 | 6.6 | 6.6 | 6.6 |
| | Inner core layer + Outer core layer | Diameter (mm) | 36.3 | 36.3 | 36.3 | 36.3 |
| | | Weight (g) | 29.7 | 29.7 | 29.7 | 29.7 |
| | | Deflection (mm) | 3.8 | 4.2 | 3.8 | 4.2 |
| | | Initial velocity (m/s) | 77.8 | 77.6 | 77.8 | 77.9 |
| | | Surface hardness (JIS-C) | 88 | 86 | 88 | 86 |
| | | Surface hardness (Shore D) | 59 | 57 | 59 | 57 |
| | | Core surface hardness − Hardness 10 mm from center (JIS-C) | 30 | 32 | 30 | 32 |
| | | Surface hardness of core outer layer − Center hardness of core inner layer (JIS-C) | 39 | 39 | 39 | 39 |
| | | Surface hardness of core outer layer − Center hardness of core inner layer (Shore D) | 30 | 30 | 30 | 30 |
| Envelope layer | Envelope layer material | Material | No. 1 | No. 1 | No. 1 | No. 3 |
| | | Material hardness (Shore D) | 51 | 51 | 51 | 46 |
| | | Thickness (mm) | 1.3 | 1.3 | 1.3 | 1.3 |
| | | Specific gravity | 0.96 | 0.96 | 0.96 | 0.96 |
| | Envelope layer-encased sphere | Diameter (mm) | 38.9 | 38.9 | 38.9 | 38.9 |
| | | Weight (g) | 35.2 | 35.2 | 35.2 | 35.2 |
| | | Deflection (mm) | 3.1 | 3.5 | 3.1 | 3.6 |
| | | Initial velocity (m/s) | 77.8 | 77.6 | 77.8 | 77.7 |
| | | Surface hardness (Shore D) | 57 | 57 | 57 | 52 |
| Surface hardness of envelope layer-encased sphere − Surface hardness of core (Shore D) | | | −2 | 0 | −2 | −5 |
| Initial velocity of envelope layer-encased sphere − Initial velocity of core (m/s) | | | 0 | 0 | 0 | −0.2 |
| Deflection of envelope layer-encased sphere/Deflection of core | | | 0.83 | 0.83 | 0.83 | 0.85 |
| Intermediate layer | Intermediate layer material | Material | No. 4 | No. 4 | No. 8 | No. 8 |
| | | Material hardness (Shore D) | 63 | 63 | 65 | 65 |
| | | Thickness (mm) | 1.1 | 1.1 | 1.1 | 1.1 |
| | | Specific gravity | 0.95 | 0.95 | 0.95 | 0.96 |
| | Intermediate layer-encased sphere | Diameter (mm) | 41.1 | 41.1 | 41.1 | 41.1 |
| | | Weight (g) | 40.5 | 40.5 | 40.5 | 40.5 |
| | | Deflection (mm) | 2.6 | 2.8 | 2.5 | 2.8 |
| | | Initial velocity (m/s) | 78.4 | 78.3 | 78.5 | 78.5 |
| | | Surface hardness (Shore D) | 69 | 69 | 71 | 71 |
| Surface hardness of intermediate layer-encased sphere − Surface hardness of envelope layer-encased sphere (Shore D) | | | 12 | 12 | 14 | 19 |

TABLE 4-I-continued

| | | | Example | | | |
|---|---|---|---|---|---|---|
| | | | 1 | 2 | 3 | 4 |
| Initial velocity of intermediate layer-encased sphere – Initial velocity of envelope layer-encased sphere (m/s) | | | 0.6 | 0.7 | 0.7 | 0.8 |
| Deflection of intermediate layer-encased sphere/ Deflection of envelope layer-encased sphere | | | 0.83 | 0.81 | 0.80 | 0.78 |
| Outer layer | Outer layer material | Material | No. 6 | No. 6 | No. 6 | No. 6 |
| | | Thickness (mm) | 0.80 | 0.80 | 0.80 | 0.80 |
| | | Specific gravity | 1.15 | 1.15 | 1.15 | 1.15 |
| | | Material hardness (Shore D) | 47 | 47 | 47 | 47 |
| | Ball | Surface hardness (Shore D) | 59 | 59 | 59 | 58 |
| | | Diameter (mm) | 42.7 | 42.7 | 42.7 | 42.7 |
| | | Weight (g) | 45.4 | 45.4 | 45.4 | 45.4 |
| | | Deflection (mm) | 2.3 | 2.6 | 2.2 | 2.6 |
| | | Initial velocity (m/s) | 77.3 | 77.2 | 77.4 | 77.4 |
| Surface hardness of ball – Surface hardness of intermediate layer-encased sphere (Shore D) | | | −10 | −10 | −12 | −12 |
| Initial velocity of ball – Initial velocity of intermediate layer-encased sphere (m/s) | | | −1.0 | −1.1 | −1.1 | −1.1 |
| Ball deflection/Deflection of intermediate layer-encased sphere | | | 0.90 | 0.90 | 0.88 | 0.93 |

TABLE 4-II

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Core | Inner core layer | Material | rubber | rubber | single rubber layer | rubber | rubber | rubber | rubber | rubber | rubber |
| | | Diameter (mm) | 23.2 | 23.2 | — | 23.2 | 23.2 | 23.2 | 21.95 | 21.95 | 23.2 |
| | | Weight (g) | 7.8 | 7.7 | — | 7.7 | 7.5 | 7.5 | 6.8 | 6.8 | 7.7 |
| | | Center hardness (JIS-C) | 49 | 47 | 60 | 49 | 49 | 49 | 50 | 50 | 47 |
| | | Center hardness (Shore D) | 29 | 28 | 38 | 29 | 29 | 29 | 30 | 30 | 28 |
| | | Hardness 5 mm from center (JIS-C) | 52 | 50 | — | 52 | 52 | 52 | 53 | 53 | 50 |
| | | Hardness 10 mm from center (JIS-C) | 58 | 54 | — | 58 | 58 | 58 | 59 | 59 | 54 |
| | | Hardness 10 mm from center – Center hardness (JIS-C) | 9 | 7 | — | 9 | 9 | 9 | 9 | 9 | 7 |
| | Outer core layer | Material | rubber | rubber | — | rubber | rubber | rubber | rubber | rubber | rubber |
| | | Thickness (mm) | 6.6 | 6.6 | — | 6.6 | 7.9 | 7.7 | 6.6 | 6.6 | 6.6 |
| | Inner core layer + Outer core layer | Diameter (mm) | 36.3 | 36.3 | 36.3 | 36.3 | 38.9 | 38.5 | 35.2 | 3.52 | 36.3 |
| | | Weight (g) | 29.8 | 29.6 | 31.1 | 29.6 | 35.2 | 34.3 | 27.9 | 27.9 | 29.7 |
| | | Deflection (mm) | 3.8 | 4.2 | 3.8 | 3.8 | 3.8 | 3.8 | 4.2 | 4.2 | 4.2 |
| | | Initial velocity (m/s) | 77.8 | 77.6 | 77.8 | 77.8 | 77.8 | 77.8 | 77.9 | 77.9 | 77.6 |
| | | Surface hardness (JIS-C) | 88 | 86 | 81 | 88 | 88 | 88 | 84 | 84 | 86 |
| | | Surface hardness (Shore D) | 59 | 57 | 54 | 59 | 59 | 59 | 56 | 56 | 57 |
| | | Core surface hardness – Hardness 10 mm from center (JIS-C) | 30 | 32 | — | 30 | 30 | 30 | 25 | 25 | 32 |
| | | Surface hardness of core outer layer – Center hardness of core inner layer (JIS-C) | 39 | 39 | 22 | 39 | 39 | 39 | 34 | 34 | 39 |
| | | Surface hardness of core outer layer – Center hardness of core inner layer (Shore D) | 30 | 30 | 16 | 30 | 30 | 30 | 26 | 26 | 30 |
| Envelope layer | Envelope layer material | Material | No. 2 | No. 1 | No. 1 | No. 1 | — | No. 1 | No. 2 | No. 1 | No. 9 |
| | | Material hardness (Shore D) | 51 | 51 | 51 | 51 | — | 51 | 51 | 51 | 51 |
| | | Thickness (mm) | 1.3 | 1.3 | 1.3 | 1.3 | — | 1.3 | 1.55 | 1.55 | 1.3 |
| | | Specific gravity | 0.95 | 0.96 | 096 | 0.96 | — | 0.96 | 0.95 | 0.96 | 0.96 |
| | Envelope layer-encased sphere | Diameter (mm) | 38.9 | 38.9 | 38.9 | 38.9 | — | 41.1 | 38.3 | 38.9 | 38.9 |
| | | weight (g) | 35.2 | 35.2 | 35.2 | 35.2 | — | 40.5 | 34.1 | 34.3 | 35.2 |
| | | Deflection (mm) | 3.1 | 3.5 | 3.1 | 3.1 | — | 3.1 | 4.2 | 4.2 | 3.5 |
| | | Initial velocity (m/s) | 77.6 | 77.6 | 77.8 | 77.8 | — | 77.8 | 77.5 | 77.7 | 76.9 |
| | | Surface hardness (Shore D) | 57 | 57 | 57 | 57 | — | 57 | 57 | 57 | 57 |
| Surface hardness of envelope layer-encased sphere – Surface hardness of core (Shore D) | | | −2 | 0 | 3 | −2 | — | −2 | 1 | 1 | 0 |
| Initial velocity of envelope layer-encased sphere – Initial velocity of core (m/s) | | | −0.2 | 0 | 0 | 0 | — | 0 | −0.4 | −0.2 | −0.7 |
| Deflection of envelope layer-encased sphere/Deflection of core | | | 0.83 | 0.83 | 0.83 | 0.83 | — | 0.83 | 1.0 | 1.0 | 0.83 |
| Intermediate layer | Intermediate layer material | Material | No. 4 | No. 5 | No. 4 | No. 3 | No. 4 | — | No. 7 | No. 7 | No. 4 |
| | | Material hardness (Shore D) | 63 | 60 | 63 | 46 | 63 | — | 62 | 62 | 63 |
| | | Thickness (mm) | 1.1 | 1.1 | 1.1 | 1.1 | 1.1 | — | 2.75 | 2.75 | 1.1 |
| | | Specific gravity | 0.95 | 0.96 | 0.95 | 0.96 | 0.95 | — | 0.95 | 0.95 | 0.95 |

TABLE 4-II-continued

| | | | Comparative Example | | | | | | | | |
|---|---|---|---|---|---|---|---|---|---|---|---|
| | | | 1 | 2 | 3 | 4 | 5 | 6 | 7 | 8 | 9 |
| | Intermediate layer-encased sphere | Diameter (mm) | 41.1 | 41.1 | 41.1 | 41.1 | 41.1 | — | 40.7 | 40.7 | 41.1 |
| | | Weight (g) | 40.5 | 40.5 | 40.5 | 40.5 | 40.5 | — | 39.7 | 39.8 | 40.5 |
| | | Deflection (mm) | 2.6 | 2.9 | 2.6 | 3.0 | 2.7 | — | 3.0 | 3.0 | 2.8 |
| | | Initial velocity (m/s) | 78.2 | 78 | 78.4 | 77.6 | 78.4 | — | 78.0 | 78.2 | 77.7 |
| | | Surface hardness (Shore D) | 69 | 66 | 69 | 52 | 69 | — | 68 | 68 | 69 |
| Surface hardnees of intermediate layer-encased sphere – Surface hardness of envelope layer-encased sphere (Shore D) | | | 12 | 9 | 12 | −5 | — | — | 11 | 11 | 12 |
| Initial velocity of intermediate layer-encased sphere – Initial velocity of envelope layer-encased sphere (m/s) | | | 0.6 | 0.4 | 0.6 | −0.2 | — | — | 0.5 | 0.5 | 0.8 |
| Deflection of intermediate layer-encased sphere/ Deflection of envelope layer-encased sphere | | | 0.83 | 0.84 | 0.83 | 0.94 | — | — | 0.70 | 0.71 | 0.81 |
| Outer layer | Outer layer material | Material | No. 6 | No. 6 | No. 6 | No. 6 | No. 6 | No. 6 | No. 6 | No. 6 | No. 6 |
| | | Thickness (mm) | 0.80 | 0.80 | 0.80 | 0.80 | 0.80 | 0.80 | 1.02 | 1.02 | 0.80 |
| | | Specific gravity | 1.15 | 1.15 | 1.15 | 1.15 | 1.15 | 1.15 | 1.15 | 1.15 | 1.15 |
| | | Material hardness (Shore D) | 47 | 47 | 47 | 47 | 47 | 47 | 47 | 47 | 47 |
| | Ball | Surface hardness (Shore D) | 59 | 58 | 59 | 57 | 59 | 57 | 58 | 58 | 59 |
| | | Diameter (mm) | 42.7 | 42.7 | 42.7 | 42.7 | 42.7 | 42.7 | 42.7 | 42.7 | 42.7 |
| | | Weight (g) | 45.4 | 45.4 | 45.4 | 45.4 | 45.4 | 45.4 | 45.5 | 45.6 | 45.4 |
| | | Deflection (mm) | 2.3 | 2.6 | 2.3 | 2.7 | 2.4 | 2.9 | 2.8 | 2.8 | 2.6 |
| | | Initial velocity (m/s) | 77.1 | 77 | 77.3 | 76.5 | 77.3 | 76.9 | 76.9 | 77.1 | 76.6 |
| Surface hardness of ball – Surface hardness of intermediate layer-encased sphere (Shore D) | | | −10 | −8 | −10 | 5 | −10 | — | −10 | −10 | −10 |
| Initial velocity of ball – Initial velocity of intermediate layer-encased sphere (m/s) | | | −1.1 | −1.0 | −1.0 | −1.1 | −1.1 | — | −1.1 | −1.1 | −1.1 |
| Ball deflection/Deflection of intermediate layer-encased sphere | | | 0.90 | 0.87 | 0.90 | 0.90 | 0.90 | — | 0.95 | 0.93 | 0.90 |

TABLE 5-I

| | | | Example | | | |
|---|---|---|---|---|---|---|
| | | | 1 | 2 | 3 | 4 |
| Flight performance | W#1 (HS, 45 m/s) | Spin rate (rpm) | 2,714 | 2,689 | 2,702 | 2,699 |
| | | Total distance (m) | 228.4 | 227.8 | 228.9 | 227.4 |
| | | Rating | good | good | good | good |
| | I#6 | Spin rate (rpm) | 5,524 | 5,383 | 5,499 | 5,425 |
| | | Total distance (m) | 176.1 | 176.6 | 176.5 | 176.8 |
| | | Rating | good | good | good | good |
| Spin on approach shots | SW (HS, 20 m/s) | Spin rate (rpm) | 6,415 | 6,442 | 6,375 | 6,368 |
| | | Rating | good | good | good | good |
| | Scuff resistance | | good | good | good | good |

TABLE 5-II

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Flight performance | W#1 (HS, 45 m/s) | Spin rate (rpm) | 2,764 | 2,789 | 2,794 | 2,919 | 2,814 | 2,925 | 2,693 | 2,643 | 2,762 |
| | | Total distance (m) | 226.9 | 226.2 | 226.8 | 223.1 | 226.8 | 224.8 | 225.9 | 226.8 | 224.4 |
| | | Rating | NG | NG | NG | NG | NG | NG | NG | NG | NG |
| | I#6 | Spin rate (rpm) | 5,623 | 5,638 | 5,674 | 5,699 | 5,630 | 5,685 | 5,343 | 5,339 | 5,501 |
| | | Total distance (m) | 175.3 | 175.0 | 174.8 | 174.1 | 175.2 | 174.5 | 176.2 | 176.3 | 174.8 |
| | | Rating | NG | NG | NG | NG | NG | NG | good | good | NG |
| Spin on approach shots | SW (HS, 20 m/s) | Spin rate (rpm) | 6,413 | 6,483 | 6,420 | 6,455 | 6,423 | 6,478 | 6,401 | 6,388 | 6,452 |
| | | Rating | good | good | good | good | good | good | good | good | good |
| | Scuff resistance | | good | good | good | good | good | good | good | good | good |

From the results in Tables 5-I and 5-II, in Comparative Example 1, the velocity of the ball was low, as a result of which a sufficient distance was not obtained. In Comparative Example 2, the resilience of the resin material used in the intermediate layer was low and the velocity of the ball was low, as a result of which a sufficient distance was not obtained. In Comparative Example 3, the core was composed of one layer and the spin rate-lowering effect was inadequate, as a result of which a sufficient distance was not obtained. In Comparative Example 4, the intermediate layer was formed so as to be soft, the initial velocity was low and the spin rate was high, as a result of which a sufficient distance was not obtained. The ball in Comparative Example 5 was a four-piece golf ball having a two-layer core and a two-layer cover and lacking an envelope layer; the spin rate was high, as a result of which a sufficient distance was not obtained. The ball in Comparative Example 6 was a four-piece golf ball having a two-layer core and a two-layer cover and lacking an intermediate layer; the spin rate was high, as a result of which a sufficient distance was not obtained. In Comparative Examples 7, the diameter of the core was small and the velocity of the ball was low, as a result of which a sufficient distance was not obtained. In Comparative Examples 8, the diameter of the core was small and the velocity of the ball was low, as a result of which a sufficient distance was not obtained. In Comparative Example 9, the (initial velocity of envelope layer-encased sphere−initial velocity of core) value was lower than −0.4 m/s and the velocity of the ball was low, as a result of which a sufficient distance was not obtained.

Japanese Patent Application No. 2014-240420 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an envelope layer encasing the core, an intermediate layer encasing the envelope layer, and a cover layer encasing the intermediate layer and having formed on an outer surface thereof a plurality of dimples, wherein the core is a two-layer core consisting of an inner core layer formed primarily of a base rubber and an outer core layer formed primarily of the same or a different base rubber, the diameter of the overall core is from 35.3 to 39 mm, the envelope layer, the intermediate layer and the cover layer are each composed of at least one layer and formed primarily of a synthetic resin material, the initial velocity of the ball is not less than 77.2 m/s, and conditions (1) to (3) below are satisfied:

(initial velocity of envelope layer-encased sphere−initial velocity of core)>−0.4 m/s; (1)

(initial velocity of intermediate layer-encased sphere−initial velocity of envelope layer-encased sphere)>0.4 m/s; and (2)

surface hardness (Shore D) of envelope layer-encased sphere<surface hardness (Shore D) of intermediate layer-encased sphere>surface hardness (Shore D) of ball. (3)

2. The multi-piece solid golf ball of claim 1, wherein the initial velocity of intermediate layer-encased sphere is not less than 78.3 m/s and the initial velocity of envelop layer-encased sphere is not less than 77.6 m/s.

3. The multi-piece solid golf ball of claim 1 which further satisfies conditions (4) and (5) below:

initial velocity of ball<initial velocity of intermediate layer-encased sphere>initial velocity of envelope layer-encased sphere; and (4)

cover thickness<intermediate layer thickness<envelope layer thickness<core diameter. (5)

4. The multi-piece solid golf ball of claim 1, wherein the two-layer core satisfies conditions (6) and (7) below:

[surface hardness (JIS-C) of core−center hardness (JIS-C) of core]≥25; and (6)

[surface hardness (JIS-C) of core−hardness (JIS-C) at position 10 mm from core center]>[hardness (JIS-C) at position 10 mm from core center−center hardness (JIS-C) of core]. (7)

5. The multi-piece solid golf ball of claim 1, wherein the two-layer core satisfies condition (7') below:

[surface hardness (JIS-C) of core−hardness (JIS-C) at position 10 mm from core center]>[hardness (JIS-C) at position 10 mm from core center−center hardness (JIS-C) of core]×2. (7')

6. The multi-piece solid golf ball of claim 1, wherein the two-layer core satisfies condition (7") below:

[surface hardness (JIS-C) of core−hardness (JIS-C) at position 10 mm from core center]>[hardness (JIS-C) at position 10 mm from core center−center hardness (JIS-C) of core]×3. (7")

7. The multi-piece solid golf ball of claim 1 which further satisfies conditions (8) and (9) below:

−10<[surface hardness (Shore D) of envelope layer-encased sphere−surface hardness (Shore D) of core]<7; and (8)

$0.75 \leq E/C \leq 0.90$, where $C$ (mm) and $E$ (mm) are the deflections of, respectively, the core and the envelope layer-encased sphere when compressed under a final load of 1,275 N (130 kgf) from an initial load of 98 N (10 kgf). (9)

8. The multi-piece solid golf ball of claim 1 which further satisfies conditions (10) and (11) below:

10<[surface hardness (Shore D) of intermediate layer-encased sphere−surface hardness (Shore D) of envelope layer-encased sphere]<25; and (10)

$0.75 \leq M/E \leq 0.85$, where $E$ (mm) and $M$ (mm) are the deflections of, respectively, the envelope layer-encased sphere and the intermediate layer-encased sphere when compressed under a final load of 1,275 N (130 kgf) from an initial load of 98 N (10 kgf). (11)

9. The multi-piece solid golf ball of claim 1 which further satisfies conditions (12) to (14) below:

−3≤[surface hardness (Shore D) of ball−surface hardness (Shore D) of intermediate layer-encased sphere]≤−20; (12)

−2.0 m/s≤(initial velocity of ball−initial velocity of intermediate layer-encased sphere)<0 m/s; and (13)

$0.85 \leq B/M \leq 0.95$, where $M$ (mm) and $B$ (mm) are the deflections of, respectively, the intermediate layer-encased sphere and the ball when compressed under a final load of 1,275 N (130 kgf) from an initial load of 98 N (10 kgf). (14)

* * * * *